US006412653B1

(12) United States Patent
Waterhouse

(10) Patent No.: US 6,412,653 B1
(45) Date of Patent: Jul. 2, 2002

(54) PLASTIC MOULDED CONTAINER WITH DETACHABLE EATING UTENSIL

(75) Inventor: Peter John Waterhouse, Hamilton (NZ)

(73) Assignee: Carter Holt Harvey Limited, Manukau City (NZ)

( * ) Notice: Subject to any disclaimer, the term of this patent is extended or adjusted under 35 U.S.C. 154(b) by 0 days.

(21) Appl. No.: 09/180,087

(22) PCT Filed: Apr. 29, 1997

(86) PCT No.: PCT/NZ97/00050

§ 371 (c)(1),
(2), (4) Date: Apr. 26, 1999

(87) PCT Pub. No.: WO97/42095

PCT Pub. Date: Nov. 13, 1997

(30) Foreign Application Priority Data

May 3, 1996 (NZ) ..... 286507

(51) Int. Cl.[7] ..... B65D 1/36; B65D 25/00

(52) U.S. Cl. ..... 220/556; 53/478; 53/485; 206/542; 220/574.1; 220/735; 426/115

(58) Field of Search ..... 220/735, 556, 220/574, 574.1, 577; 215/DIG. 5; 206/559, 542, 541, 518; 229/400; 426/115, 120, 396; 53/478, 485

(56) References Cited

U.S. PATENT DOCUMENTS

| | | | | | |
|---|---|---|---|---|---|
| 1,138,288 | A | * | 5/1915 | Harper | 220/575 |
| 1,514,379 | A | * | 11/1924 | Fleischer | 426/115 X |
| 1,607,864 | A | * | 11/1926 | Butler | 220/735 X |
| 3,586,161 | A | * | 6/1971 | Fong et al. | 215/DIG. 5 X |
| 3,704,779 | A | * | 12/1972 | Nigg | 220/735 X |
| 3,722,779 | A | * | 3/1973 | Chang | 220/735 X |
| 3,982,655 | A | * | 9/1976 | Kaupert | 206/518 X |
| 4,013,798 | A | * | 3/1977 | Goltsos | 220/556 X |
| 4,060,176 | A | * | 11/1977 | Tobiasson | 220/212 |
| 5,167,973 | A | * | 12/1992 | Snyder | 426/120 X |
| 5,443,174 | A | * | 8/1995 | Bauer | 206/541 X |
| 5,496,575 | A | * | 3/1996 | Newarski | 206/541 X |
| 5,938,068 | A | * | 8/1999 | Atkins et al. | 220/266 X |

FOREIGN PATENT DOCUMENTS

| | | | | |
|---|---|---|---|---|
| AU | 80151/87 | | 5/1988 | |
| DE | 3242257 | | 5/1984 | |
| GB | 2067156 | * | 7/1981 | 206/542 |

* cited by examiner

*Primary Examiner*—Allan N. Shoap
*Assistant Examiner*—Joe Merek
(74) *Attorney, Agent, or Firm*—Jacobson, Price, Holman & Stern, PLLC

(57) ABSTRACT

The invention relates to a moulded plastic container which defines at least one receptacle for receiving a food material or the like, the container further including a utensil such as a spoon which is frangibly detachable from the container when the utensil is to be used for mixing, stirring or eating purposes. In a preferred form of the invention the moulded plastic container has two receptacles adjacent each other wherein the utensil is provided between the two receptacles along a fold axis between each of the receptacles, the fold axis allowing for the pivoting of each of the receptacles relative to each other for the transferring of contents from one receptacle to the other.

48 Claims, 6 Drawing Sheets

Figure 1:
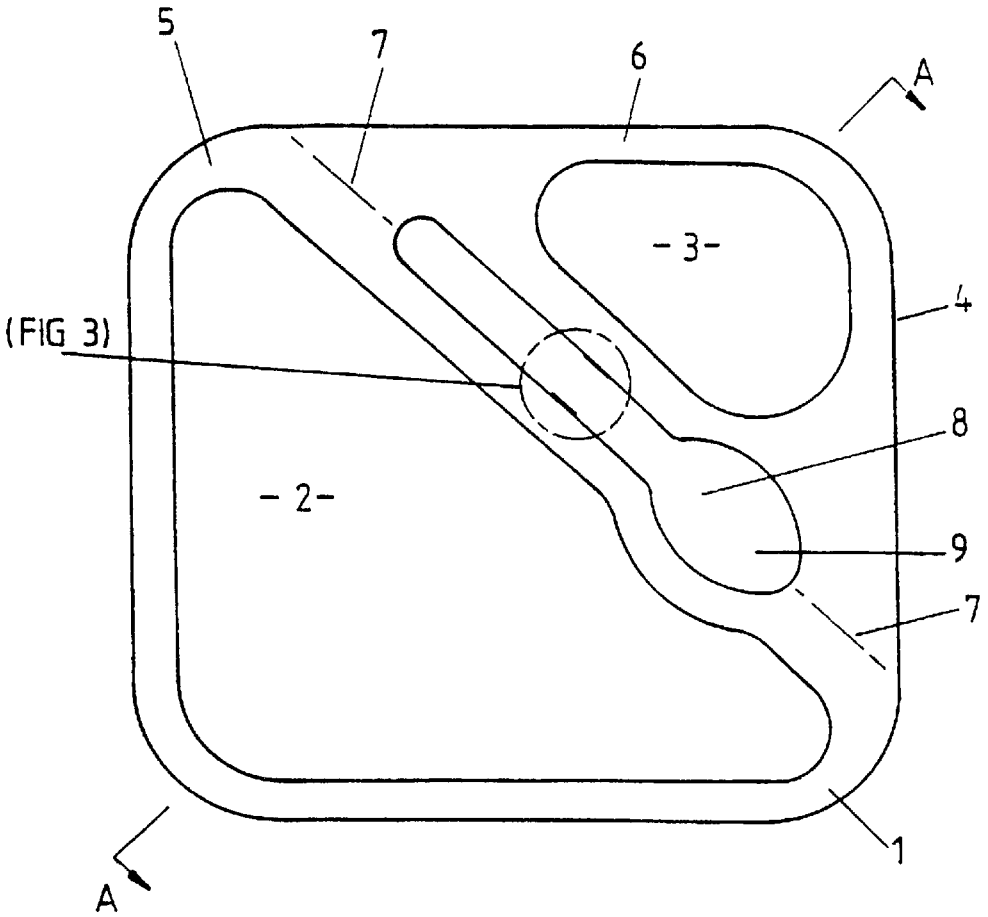

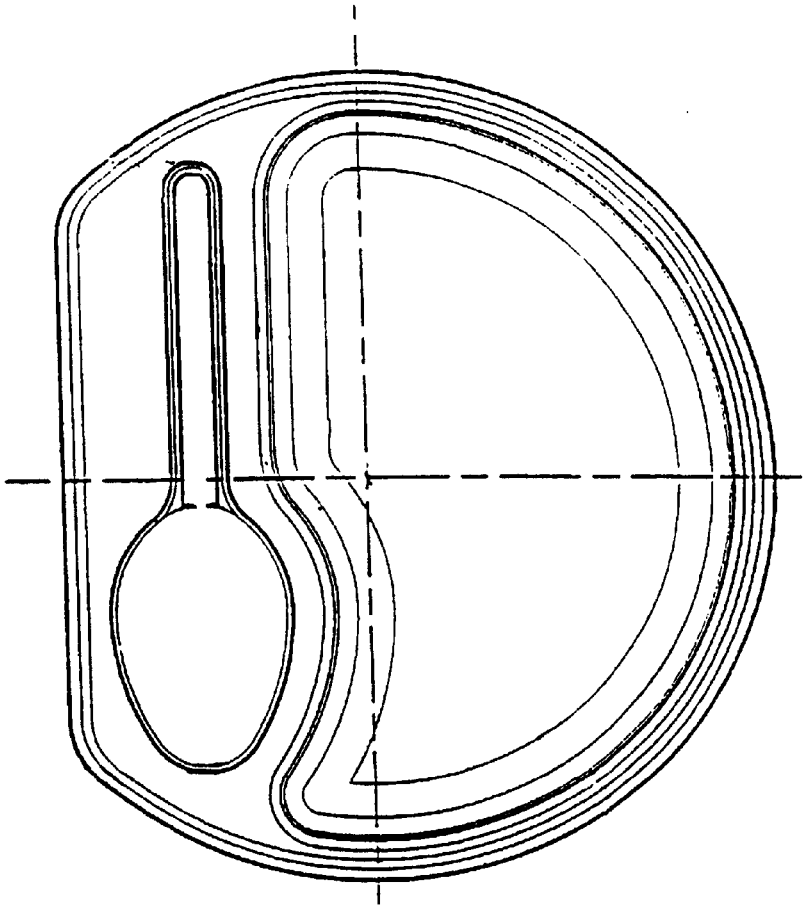
FIG 11 ↑A
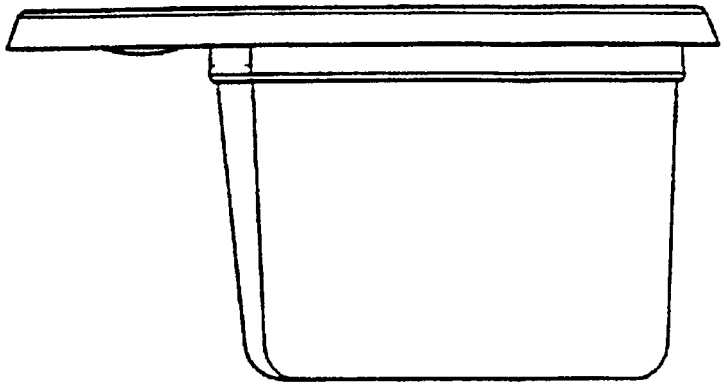
FIG 12

PLASTIC MOULDED CONTAINER WITH DETACHABLE EATING UTENSIL

The present invention relates to improvements in and/or relating to packaging and related products and means suitable for both food and other products.

Foodstuffs such as yoghurts and the like are frequently supplied in a foil or other film lidded container with the liquid or gel like contents being confined within a pocket formed in a vacuum moulded plastics member. Such vacuum form moulding of a food grade plastics material (such as a suitable polystyrene or polyolefin) tray having receptacle characteristics is well known in the art and is used to provide receptacles for materials as diverse as butter through to yoghurts, breakfast cereals, fruit purees, etc.

It is therefore an object of the present invention to provide a food or other material packaging which will at least provide the public with a useful choice.

The present invention is therefore directed to such packaged products, the packaging itself including the container (receptacle) thereof and the means of forming such packaging as well as various aspects of its use and, as such, the present invention should provide the public with a useful choice. This is irrespective of whether or not it is for food.

Accordingly in a first aspect the present invention consists in a moulded plastics container or tray (hereafter "tray") which defines at least one receptacle capable of containing a material (such as a foodstuff) and which defines at least one of a) a frangibly detachable spoon or the equivalent eating utensil, and/or b) a frangibly detachable mixing utensil, the frangibly detachable spoon or the equivalent eating utensil and/or mixing utensil being detachable and useable within said at least one receptacle.

Preferably said moulded plastics tray has been moulded from a web of sheet thermoplastic material.

Preferably a spoon is present.

Preferably said spoon is positioned (when attached to said tray) with the bowl of the spoon facing upwardly with respect to the opening of the at least one receptacle which also opens upwardly.

Preferably said tray is substantially planar save for the receptacle(s) formed therein and the frangibly detachable item (a) and/or (b).

Preferably there are two adjacent receptacles defined.

Preferably said frangibly detachable item (a) and/or (b) is positioned between said receptacles.

Preferably each receptacle is provided with an outer substantially planar rim about the periphery of the opening of each receptacle, said two receptacles integrally connected (and optionally frangibly connected) along a region or regions of said rim of each receptacle.

Preferably said tray has a fold axis defined by a line of weakening (whether continuous or not) at said region or regions of each said rim of said two receptacles to allow appropriate pivoting of the receptacles to transfers (when at least one of said receptacles contains said food stuff) at least some of the contents of at least one receptacle into the other receptacle.

Preferably a contoured relief is provided (when viewed in plan view) extending toward the receptacle from the perimeter of each rim and along said fold axis, each relief adapted to the or a portion of the contour shape of said frangibly detachable item (a) and/or (b), said reliefs defining a region within which said frangibly detachable item (a) and/or (b) is positioned.

Preferably said tray includes (after filling of each of the receptacles with desired material) means which seals over the opening of said at least one receptacle.

Preferably each of said receptacles (and preferably said frangibly detachable item (a) and/or (b)) are covered by said means which seals over said opening, by engagement onto at least part of said rim of each receptacle.

Preferably said means which seals is of a film material and is securable to said rim(s) or part thereof by a suitable adhesive.

Preferably said frangibly detachable item (a) and/or (b) is aligned with its elongate axis substantially on said fold axis.

Preferably said fold axis is adapted to be frangible to allow dis-engagement of said two receptacles.

Preferably at least one of said rims is provided with frangible bridging region(s) connecting said frangibly detachable item (a) and/or (b) with said tray.

Preferably both rims provide said frangible bridging region(s).

Preferably the tray is formed from said web of sheet thermoplastic material by application of a pressure differential between the major surfaces of said web of sheet thermoplastic material (eg; by vacuum forming).

Preferably said frangibly detachable item (a) and/or (b) is defined (ie the perimeter shape) after forming from said web of sheet thermoplastic material.

Preferably the arrangement is substantially as herein described with reference to any or all of the accompanying drawings.

In a second aspect the present invention consists in a pack comprising a moulded container as claimed in any one of the preceding claims, at least one foodstuff positioned in a said receptacle of said tray and a cover for said at least one receptacle to confine the content of said receptacle(s).

Preferably a film material (whether moulded of sprayed) is provided to and/or part of said package to underlie said frangibly detachable item (a) and/or (b).

In a further aspect the present invention consists in a method of packing a food or other material in a tray as herein described comprising filling the at least one receptacle of said tray with a said food material, thereafter overlying and affixing about the opening of the material containing receptacle with a foil or other web like material.

Preferably the food or other material is a foodstuff.

Preferably the second of said two receptacles is also filled with a similar or different food or other material.

Preferably said foil of web like material overlies said two receptacles and said frangibly detachable item (a) and/or (b).

Preferably a film material (whether moulded of sprayed) is provided to and/or part of said package to underlie said frangibly detachable item (a) and/or (b).

Irrespective of whether or not there is a hinge axis and irrespective of whether or not any such hinge axis is frangible preferably a spoon is formed (preferably as the overall container is being formed by a vacuum forming process from a web of an appropriate food grade plastics material—preferably of constant thickness) so as to be frangibly connected by readily frangible bridging regions.

While a spoon is referred to as a preference where the material(s) being packaged is foodstuff(s), any type of mixing or uplifting utensil may instead be provided. Examples of such materials include any material required in small volume but preferably are both materials (separate) of binary or the like systems. Examples include adhesives and settable resins.

Certainly using polyester or epoxy resins for fibreglass repair spring to mind, having the mixing container, reagents and mixing utensil all in one pack with correct measured quantities would be a potential use.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

Figure 2:
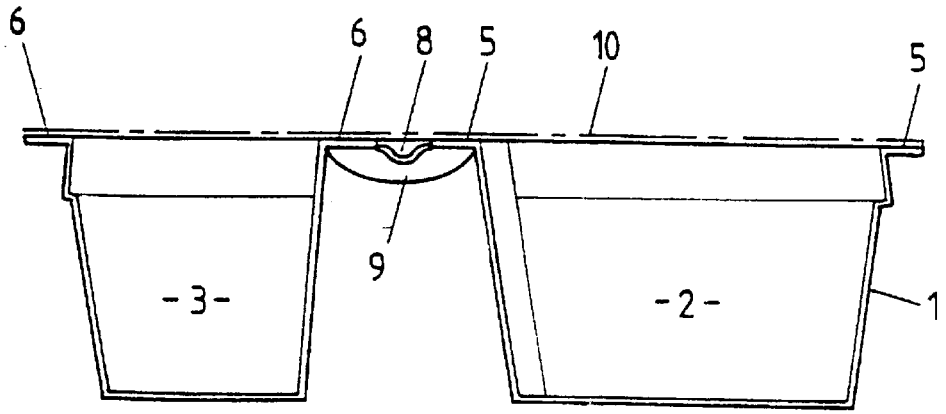
Figure 3:
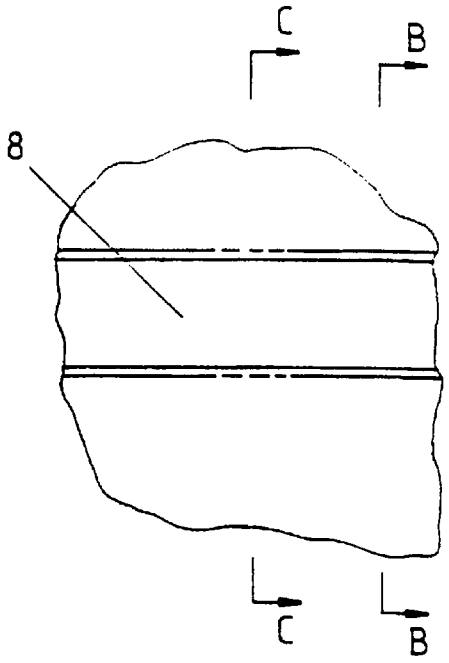
Figure 4:
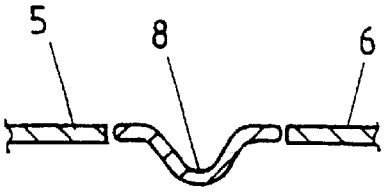
Figure 5:
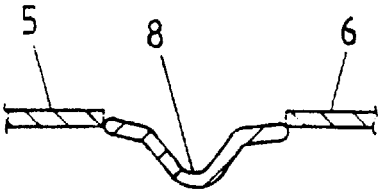
Figure 6:
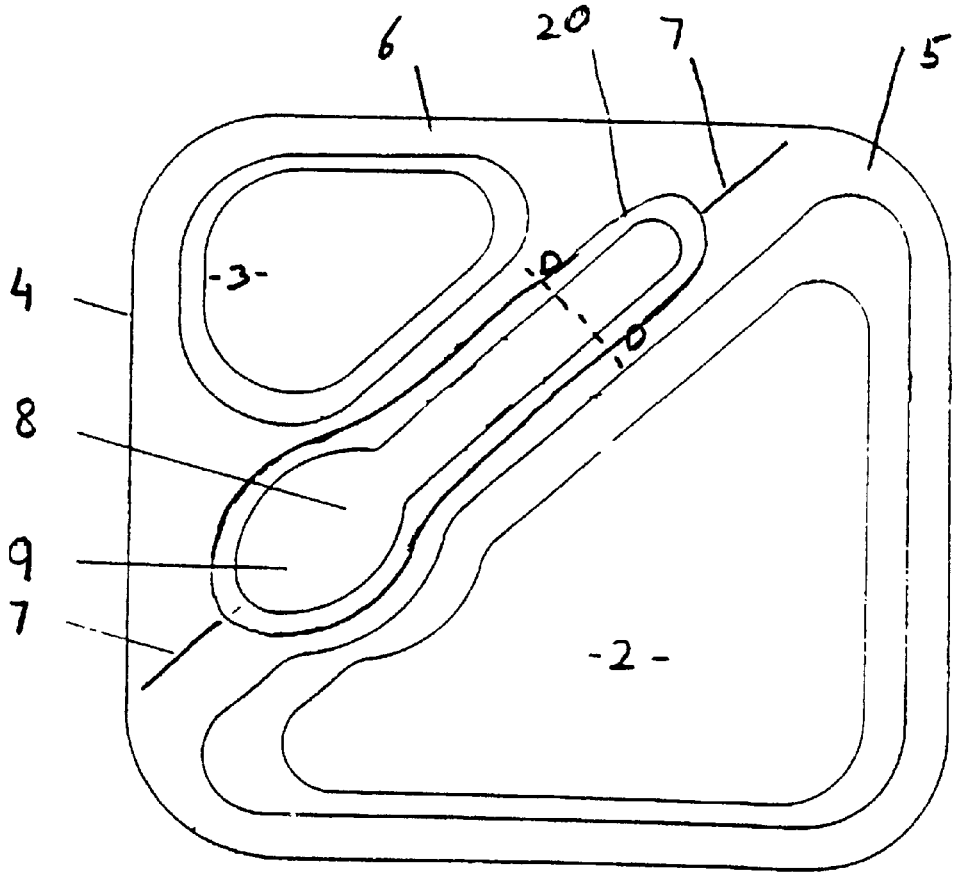
Figure 7:
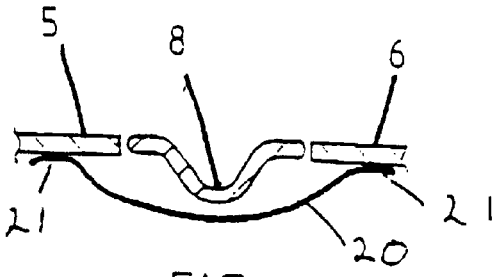
Figure 8:
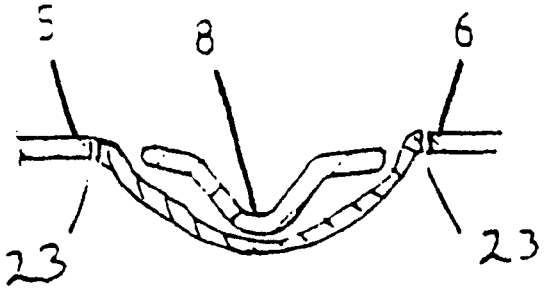
Figure 9:
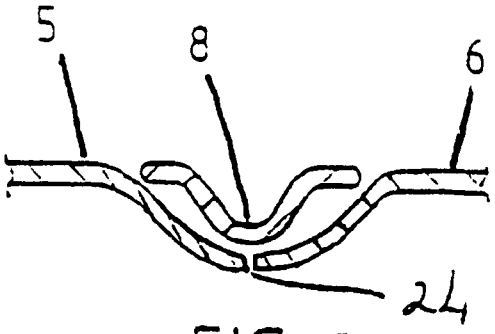
Figure 10:
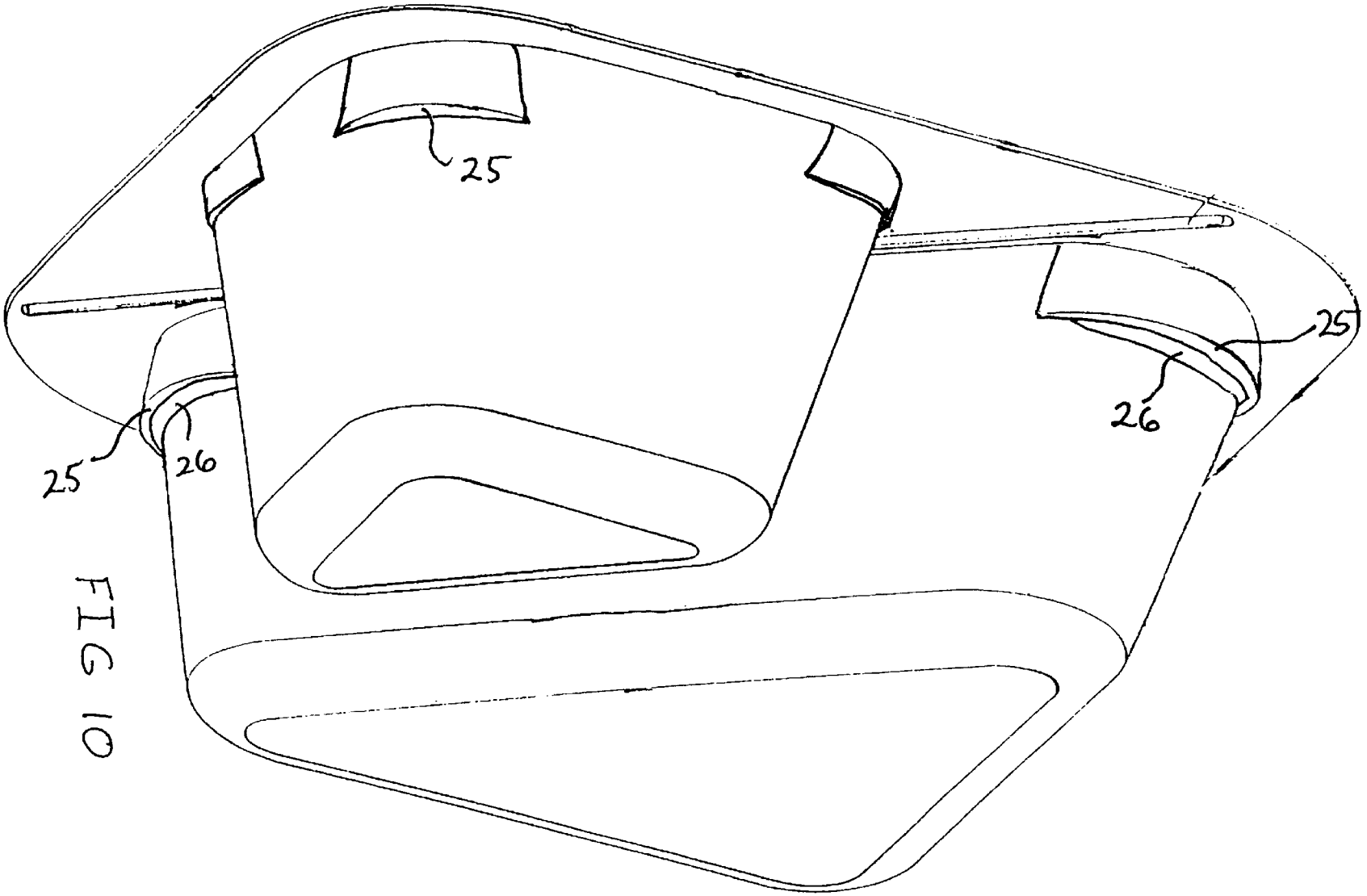

A preferred form of the present invention will now be described with reference to the accompanying drawings in which;

FIG. 1 is a plan view of one form of a container in accordance with the present invention showing a generally square or rectangular form insofar as external periphery is concerned but showing two receptacles, the smaller one being suitable, by way of example, for retaining yoghurt and the larger being suitable for retaining, for example, a breakfast cereal [or alternatively the smaller suitable for retaining a cream or milk product while the larger retains a breakfast cereal, or one containing a puree with the other a cereal or yoghurt, etc.], FIG. 2 is a diagrammatic side elevation arrangement at section "AA" of the arrangement of FIG. 1, ie; looking normally of the longitudinal axis of the spoon which is the preferred eating or mixing utensil and looking towards the bowl of the spoon, the bottom surface of which is seen protected (but uncovered) between the two receptacles, FIG. 3 is a plan view of the spoon handle detail at the region of the broken circle as depicted, FIG. 4 is a scrap section at "BB" with respect to FIG. 3, FIG. 5 is a scrap section at "CC" with respect to FIG. 3, FIG. 6 is a bottom view of an alternative form of the package wherein an additional cover providing means is provided enveloping and enclosing the underside of the utensil, FIG. 7 is a scrap section at "DD" with respect to FIG. 6, FIG. 8 is a scrap section at "DD" with respect to FIG. 6, wherein instead of the foil being affixed to the underside of the package, it is moulded as part of the package to form a hollow for the utensil to sit in, FIG. 9 is a scrap section at "DD" with respect to FIG. 6 wherein the tray is frangible through its centerline, FIG. 10 is a bottom perspective view of a preferred form of the present invention illustrating on the larger of the two receptacles the wedge providing members, FIG. 11 is a plan view of an alternative configuration of a package of the present invention in an uncovered configuration, and FIG. 12 is a view in direction "A" of the package of FIG. 11.

In the preferred form of the present invention the receptacle 1 is formed by either injection moulding or more preferably from a vacuum moulding procedure from a feedstock of an appropriate food grade plastics material such as about 1 mm thickness of polystyrene.

The reference to "vacuum" moulding or forming herein refers to the application of a pressure differential between one and the other side of the web of sheet thermoplastic material from which the pack/tray of the present invention is formed, whether it is a positive pressure on the side of the web material from which the web material forms into the mould or whether it is a low pressure (vacuum) on the other side to draw the web of material into the mould in order to form the pack/tray. It may even indeed be the combination of both.

As can be seen in the preferred form of the present invention there are a plurality of receptacles with receptacle 2 and receptacle 3 being shown of two different sizes and disposed diametrically apart with respect to the outer periphery.

The outer periphery 4 in the preferred form of the present invention includes a rim region 5 surrounding the receptacle 2 and a rim region 6 that surrounds the receptacle 3 and such rim regions (even if strengthened by contouring) are preferably generally coplanar. Interposed between the two rim regions is preferably a hinge axis 7 and on that axis is preferably the preferred eating and/or mixing utensil 8 which includes a bowl 9.

Overlaying the filled receptacles 2 and 3 only after the container has been presented to appropriate filling stations is a foil or web of appropriate plastics material that is preferably sequentially applied from container to container and is preferably welded or otherwise adhesively fixed to said rim surface(s).

Shown in FIG. 1 is a direction of extrusion of the material from which the container is vacuum or otherwise moulded in the preferred form. The direction of extrusion on the drawing is shown to indicate the alignment of the machine direction of the extruded sheet. The sheet is easy to shear along the machine direction and difficult to shear across the machine direction, such that if the orientation of the spoon and hinge area is across the machine direction, it is likely that the spoon would be in two pieces rather than one after removal. Shown as 10 in dotted outline in FIG. 2 the film or foil material 10 which overlies both receptacles 2 and 3 and any contents contained therein (not shown in FIG. 2) as well as the upper surface of the utensil 8. Such foil (aluminium or composite) or plastics film (or composite) 10 is preferably affixed by heat seal lacquer adhesive.

In less preferred forms the film cover can be extruded direct on to the rims while hot or a tacky foil process used.

This pack is generally used as a two part pack for yoghurt and cereal type products, the yoghurt being in the larger pocket and the cereal in the smaller pocket.

In addition to the preferred form of the invention as describe above, the package may also be provided with a cover providing means as shown in FIG. 6.

Preferably the cover providing means envelops the bottom of the spoon (when in a non-separated condition) and provides a protective layer to the underside of the utensil. Most preferably the cover providing means 20 is affixed to the package as a subsequent process after the packages shown in FIGS. 1–5 has been formed. Preferably it is located about the peripheral region of the utensil 8. Preferably such location is to the rim regions 5 and 6 on each side of the hinge axis 7.

Most preferably the cover providing means is a foil seal and is fitted as a secondary process to the rim regions 5 and 6 by suitable adhering means such as heat sealing, RF sealing, ultra sound, welding, or suitable adhesive sealing at points 21. Most preferably the foil seal is preshaped to correspond to the bottom surface(s) of the spoon (or utensil) and is adhered to the package most preferably continuously about its perimeter. However such sealing may be of a discontinuous nature around the perimeter. The foil need not necessarily be preshaped and may have sufficient flexibility to conform to the desired shape.

Alternatively as shown in FIG. 8 there is provided and moulded as part of the package, a receptacle region of a hollow or depressed nature or the like for receiving a separate utensil such as a spoon. In this preferred form the receptacle region is shaped suitably to receive the utensil and may be frangible about the periphery thereof at 23. Alternatively the frangible region may be along the centerline as shown in FIG. 9 along 24. Such frangible region(s) shown in FIGS. 8 and 9 may (a) provide access to the utensil though the bottom of the package but are/is preferably there to (b) allow the package to be bent so that the content of one tray is able to be emptied into the other. In some yet other forms of the present invention a sprayable composition can be provided after the forming of the tray to the underside of the utensil.

The tray of the present invention is preferably adapted to be stackable with like adjacent trays to allow for stacking for filling, transportation or other like reasons. FIG. 10 shows a further embodiment of the present invention where at least the big receptacle has the stack supporting shoulder 25 having provided thereunder a chamfer 26 (or wedge providing means) which will provide a wedging effect occurs to ensure a positive placement of each shoulder 25 on a rim region of the like container thereunder in a stack.

Where as depicted in FIG. 10 there are a plurality of receptacles such a chamfer can, if desired, be provided on each of the stack indexing features but not necessarily so provided there is at least in respect of one of the receptacles, preferably a positive location horizontally of a container or tray in the stack.

Also within the scope of the present invention is the provision of a plurality of utensils on or in a single tray or container, preferably each of which is frangible although not necessarily so. Some can, if desired, be located within a recess underlying the foil or cover for the receptacle or receptacles of the tray or extensions thereof. In addition the present invention also envisages a tray having a single receptacle as shown in FIGS. 11, and 12.

To enable the product to be better utilised as a snack food, it is desirable to include a spoon at the point of manufacture.

This tray includes a spoon formed into the dividing surface between the two receptacles. The spoon is nearly completely cut out from the top surface of the tray expect for two retainer areas placed at the midpoint of the spoon at either side of the handle. These areas are not completely cut and retain the spoon to the tray.

The top of the tray is covered by a foil or web like material which is heat sealed around each pocket, also covering the top face of the spoon.

The consumer peels the foil from the pack, then pushes down on the bowl end of the spoon, this causes the spoon to pivot around the retentions at the midpoint. This action also propagates a split in the retention area parallel to the handle of the spoon due to the retentions being aligned with the direction of orientation of the sheet. (manufacturing machine direction).

The spoon is then grasped by the upward standing handle and removed from the pack with a twisting action.

The pack can also be bent along the hinge line to tip the contents of the smaller bowl into the larger bowl should the customer so desire. It is also possible to separate the large and small bowl in this manner if so desired. Along the hinge axis which preferably has a line (whether continuous or not) along at least part of the axis.

The primary advantage is that this pack can be made in a single manufacturing operation in a single or multistage thermoformer (although more suited to a single stage thermoformer).

The current packs on the market which include a spoon utilise a separate spoon which must be fitted to the tub in a separate ancillary operation. These ancillary operations are expensive in terms of unit cost and capital requirements for assembly machines.

They also add significantly to the ongoing costs of the product and require longer lead times to manufacture as the multistage process takes more time to produce a finished product than a single stage process.

Approximate capital requirements for the separate spoon and tub system are in the order of 1996 NZ$350,000.00 to purchase tooling for the spoon, tub, and an assembly machine, commissioned, ready to run. Capital requirements for the single stage process "spoonpak" product are in the order of 1996 NZ$65,000.00.

Features of Importance in the Preferred Forms Include

1. Single or multistage manufacture of a pack with a removable shaped spoon (or other utensil from a single sheet of feed stock using the thermoforming process.
2. The incomplete cutting out of the spoon at the midpoint being used to retain the spoon in the pack until the end user removes it.
3. The alignment of the direction of extrusion of the sheet parallel with the side of the handle to enable the thermoplastic polymer cleanly shear out when the spoon is twisted out after depressing the bowl area inwardly.
4. The improvement of the performance of the hinge area of the container by the removal of the centre area, being the spoon. The current products are nearly impossible to bend along the intended hinge line, whereas this product has a significantly smaller hinge area, able to flex easily and also to be fully separable if desired.

What is claimed is:

1. A moulded plastics tray, said tray having been formed from a sheet of a thermoplastics sheet material having a machine direction in a plane in which the sheet has been extruded, comprising at least one receptacle formed out of the plane of the sheet, and an elongate utensil capable, when detached from the remainder of the material of the tray, of being used either (i) as an eating utensil for a product to be positioned within said at least one receptacle, or (ii) as a mixing or lifting utensil for a product to be positioned within said at least one receptacle, said sheet, at least substantially in said plane, (a) defines a rim about a top of said at least one receptacle, and (b) fully surrounds a perimeter of said elongate utensil, and a part of the sheet surrounding the elongate utensil is bridged to said utensil only at a region substantially midway along a length thereof, and rupture of the bridging being facilitated by the machine direction being at least substantially aligned to a longitudinal axis of said elongate utensils, and a fold axis defined in said material of the sheet, a fold line extending along said fold axis, said fold line being split by a length of said utensil such that each split is located on an opposite side of the utensil, whereby folding at said fold axis assists in the rupturing of the bridging.

2. The tray as claimed in claim 1, wherein said utensil is a spoon and is formed with upper extremities of the spoon level with or below said top of said receptacle.

3. The tray as claimed in claim 2, wherein an opening of said spoon is in a same upward direction as said at least one receptacle.

4. The tray as claimed in claim 1, wherein the bridging is rupturable upon rotation of said utensil about the bridging which causes one end region of the utensil to move out of the plane of the sheet with the other end region making a substantially corresponding movement out of the plane to the other side of the sheet.

5. The tray as claimed in claim 1, wherein the bridging comprise two sets of bridges, one on either side of the utensil, each set of said bridges being in close proximity but sufficiently far apart so as to provide stability of the utensil relative to the plane of the sheet.

6. The tray as claimed in claim 1, wherein there are at least two receptacles and said utensil lies between the at least two receptacles, at least some of the material of the sheet providing a rim for each receptacle and surrounding said utensil.

7. A moulded plastics tray, said tray having been formed from a sheet of a thermoplastics sheet material, comprising at least one receptacle formed out of a plane of the sheet, and an elongate utensil capable, when detached from a remainder of the material of the tray, of being used as an eating utensil for a product to be positioned within said at least one receptacle, said sheet at least substantially in said plane (a) defines a rim about a top of said at least one receptacle, and (b) fully surrounds a perimeter of said elongate utensil, and a part of the sheet surrounding the elongate utensil being bridged to said utensil by readily rupturable bridges, and said bridges being located spaced from a portion of said utensil adapted to be inserted into a user's mouth, and at least a portion of a perimeter of the utensil is cut whilst the sheet material is within the forming mould, a fold axis defined in said material of the sheet, a fold line extending along said fold axis, said fold line being split by a length of said utensil such that each split is located on an opposite side of the utensil, whereby folding at said fold axis assists in the rupturing of the bridges.

8. The tray of claim 7, wherein the bridges extend to the elongate utensil at a region substantially midway along a length thereof.

9. The tray as claimed in claim 7, wherein said utensil is a spoon and is formed with upper extremities of the spoon level with or below said top of said receptacle.

10. The tray as claimed in claim 9, wherein an opening of said spoon is in a same upward direction as said at least one receptacle.

11. The tray as claimed in claim 7, wherein the bridging is rupturable upon rotation of said utensil about the bridging which causes one end region of the utensil to move out of the plane of the sheet with the other end region making a substantially corresponding movement out of the plane to the other side of the sheet.

12. The tray as claimed in claim 7, wherein the bridging comprise two sets of bridges, one on either side of the utensil, each set of said bridges being in close proximity but sufficiently far apart so as to provide stability of the utensil relative to the plane of the sheet.

13. The tray as claimed in claim 7, wherein there are at least two receptacles and said utensil lies between the at least two receptacles, at least some of the material of the sheet providing a rim for each receptacle and surrounding said utensil.

14. A moulded plastics trays formed from a sheet of a thermoplastics material and comprising a first receptacle, at least a second receptacle, and an elongate utensil capable, when detached from a remainder of the material of the tray, of being used either (i) as an eating utensil, or (ii) as a mixing or lifting utensil, said sheet (a) defines a rim about each of said receptacles, and (b) fully surrounds a perimeter of said utensil, said utensil being connected to the tray only by bridges capable of being readily ruptured to allow utensil removal, and said elongate utensil being positioned to extend substantially below a plane extending between downwardly depending walls of the at least two receptacles, a fold line defined in said material of the sheet, said fold line being split by a length of said utensil such that each split is located on an opposite side of the utensil.

15. The moulded plastics tray as claimed in claim 14, wherein each of the receptacles is nestable into a corresponding receptacle of another tray, the downwardly depending walls of at least some receptacles being contoured to define means whereby, when so nested into another tray, both the respective said utensils and the respective planes are spaced apart by a same amount.

16. A unitary moulded plastics tray comprising a) two proximate receptacles capable of containing a material each having an opening and a substantially planar rim defining region, a portion of said rim defining region located intermediate said two receptacles having a line of weakening adapted to allow pivotal rotation of said receptacles relative to each other to aid in transfer of material from one of said receptacles to the other of said receptacles, b) a frangibly detachable utensil of longitudinal shape, detachable and useable within said at least one receptacle, said frangibly detachable utensil being located between and formed from said portion of the rim defining regions located intermediate of said two receptacles, a fold line extending along said line of weakening, said fold line being split by a length of said utensil such that each split is located on an opposite side of the utensil.

17. The unitary moulded plastic tray as claimed in claim 16, wherein said frangibly detachable utensil is a spoon and is formed with upper extremities of the spoon level with or below said planar rim defining region.

18. The unitary moulded plastic tray as claimed in claim 16, wherein a periphery of said rim defining region is of a quadrilateral shape, the line of weakening extending from one edge of the periphery to an opposite edge of the periphery.

19. The unitary moulded plastic tray as claimed in claim 18, wherein said line of weakening extends at an acute angle from said one edge of said periphery to said opposite edge of said periphery.

20. The unitary moulded plastic tray as claimed in claim 16, wherein said line of weakening is co-extensive with a longitudinal direction of the frangibly detachable utensil.

21. The unitary moulded plastic tray as claimed in claim 16, wherein said tray includes material sealing over the opening of said at least one receptacle.

22. The unitary moulded plastic tray as claimed in claim 21, wherein each of said receptacles are covered by said material by engagement of said material onto at least part of said rim of each receptacle.

23. The unitary moulded plastic tray as claimed in claim 22, wherein said material is a film material and is securable to said rim by an adhesive.

24. The unitary moulded plastic tray as claimed in claim 16, wherein said line of weakening is adapted to be frangible to allow dis-engagement of said two receptacles.

25. The unitary moulded plastic tray as claimed in claim 16, wherein at least one of said rims is provided with a frangible bridging region connecting said frangible detachable utensil with said tray.

26. The unitary moulded plastic tray as claimed in claim 25, wherein both rims provide said frangible bridging region.

27. A method of packing a material in a tray comprising a) two proximate receptacles capable of containing a material each having an opening and a substantially planar rim defining region, a portion of said rim defining region located intermediate said two receptacles having a line of weakening adapted to allow pivotal rotation of said receptacles relative to each other to aid in transfer of material from one of said receptacles to the other of said receptacles, b) a frangibly detachable utensil of longitudinal shape, detachable and useable within said at least one receptacle, said frangibly detachable utensil being located between and formed from said portion of the rim defining region located intermediate of said two receptacles, a fold line extending along said line of weakening, said fold line being split by a length of said utensil such that each split is located on an opposite side of the utensil, said method comprising filling the at least one receptacle of said tray with said material, thereafter overlying and affixing about the opening of the material containing receptacle with a foil or other web material.

28. The method as claimed in claim 27, wherein the material is a foodstuff.

29. The method as claimed in claim 27, wherein the second of said two receptacles is also filled with a material.

30. The method as claimed in claim 27, wherein said foil or other web material overlies said two receptacles and said frangibly detachable utensil.

31. The method as claimed in claim 27, wherein a film material is provided to underly said frangibly detachable utensil.

32. A unitary moulded plastics tray comprising a) two proximate receptacles capable of containing a material, each having an opening and a substantially planar rim defining region, a portion of said rim defining region located intermediate said two receptacles having a line of weakening adapted to allow pivotal rotation of said receptacles relative to each other, b) a frangibly detachable utensil of a longitudinal shape, detachable and useable within said at least one receptacle, said frangibly detachable utensil being located between and formed from said portion of the rim defining regions located intermediate of said two receptacles, a fold line extending along said line of weakening, said fold line being split by a length of said utensil such that each split is located on an opposite side of the utensil, at least one pair of frangible bridging regions for said frangibly detachable utensil, each of said at least one pair of bridging members being located on each side of said line of weakening whereby upon pivotal rotation of said receptacles and the resultant displacement of said at least one pair of bridging regions causes at least one of said pair of bridging regions to rupture to thereby allow easy removal of said frangibly detachable utensil.

33. The unitary moulded plastic tray as claimed in claim 32, wherein said frangibly detachable utensil is a spoon and is formed with upper extremities of the spoon level with or below said planar rim defining region.

34. The unitary moulded plastic tray as claimed in claim 32, wherein a periphery of said rim defining region is of a quadrilateral shape, the line of weakening extending from one edge of the periphery to an opposite edge of the periphery.

35. The unitary moulded plastic tray as claimed in claim 34, wherein said line of weakening extends at an acute angle from said one edge of said periphery of said rim defining region to said opposite edge of the rim defining region.

36. The unitary moulded plastic tray as claimed in claim 32, wherein said line of weakening is co-extensive with a longitudinal direction of the frangibly detachable utensil.

37. The unitary moulded plastic tray as claimed in claim 32, wherein said tray includes material sealing over the opening of said at least one receptacle.

38. The unitary moulded plastic tray as claimed in claim 37, wherein each of said receptacles are covered by said material by engagement of said material onto at least part of said rim of each receptacle.

39. The unitary moulded plastic tray as claimed in claim 38, wherein said material is a film material and is securable to said rim by an adhesive.

40. A unitary moulded plastic tray as claimed in claim 32 wherein said line of weakening is adapted to be frangible to allow dis-engagement of said two receptacles.

41. The unitary moulded plastic tray as claimed in claim 32, wherein at least one of said rims is provided with a frangible bridging region connecting said frangibly detachable utensil with said tray.

42. The unitary moulded plastic tray as claimed in claim 41, wherein both rims provide said frangible bridging region.

43. A moulded plastics tray, said tray having been formed from a sheet of thermoplastics sheet material, said tray comprising two receptacles formed out of a plane of the sheet, and an elongate utensil formed out of the plane of the sheet intermediate of said two receptacles and capable, when detached from a remainder of the material of the tray, of being used as an eating utensil, said sheet (a) defines a rim about said receptacles, and (b) fully surrounds a perimeter of said elongate utensil, and (c) is provided with a line of weakness for folding of said two receptacles relative to each other, a fold line extending along said line of weakening, said fold line being split by a length of said utensil such that each split is located on an opposite side of the utensil, and a part of the sheet surrounding the elongate utensil being bridged to said utensil by readily rupturable bridges, and said bridge being spaced from a portion of said utensil adapted to be inserted into a user's mouth.

44. The tray of claim 43, wherein the bridges extend to the elongate utensil at a region substantially midway along a length thereof.

45. The tray as claimed in claim 43, wherein said utensil is a spoon and is formed with upper extremities of the spoon level with said plane.

46. The tray as claimed in claim 45, wherein an opening of a bowl of said spoon is in a same upward direction as an opening of said two receptacles.

47. The tray as claimed in claim 43, wherein the bridges are rupturable upon rotation of said utensil and movement of end regions of the utensil out of the plane of the sheet.

48. The tray as claimed in claim 43, wherein the rupturable bridges comprise two sets of bridges, one on either side of the utensil, each set of said bridges being in close proximity but sufficiently far apart so as to provide stability of the utensil relative to the plane of the sheet.

* * * * *